United States Patent [19]

Powell

[11] 3,948,315

[45] Apr. 6, 1976

[54] CLOSURE FOR HEAT EXCHANGER

[75] Inventor: John R. Powell, Tulsa, Okla.

[73] Assignee: Brown Fintube Company, Tulsa, Okla.

[22] Filed: Aug. 13, 1974

[21] Appl. No.: 497,108

[52] U.S. Cl. ..... 165/70; 165/143; 165/158; 285/14; 285/110; 285/137 R; 285/363; 165/76

[51] Int. Cl.[2] ..... F28F 11/00; F28F 9/08

[58] Field of Search ..... 165/81, 82, 158, 70, 76; 285/14, 137, 110, 321, 363; 220/327, 378

[56] References Cited

UNITED STATES PATENTS

| | | | |
|---|---|---|---|
| 3,079,992 | 3/1963 | Otten et al. | 165/163 X |
| 3,377,087 | 4/1968 | Samerdyke et al. | 285/137 R |
| 3,424,480 | 1/1969 | Holland | 285/363 X |

*Primary Examiner*—Charles J. Myhre
*Assistant Examiner*—Theophil W. Streule
*Attorney, Agent, or Firm*—Burns, Doane, Swecker & Mathis

[57] ABSTRACT

A closure for a heat exchanger of the shell and tube type in which fluid under high pressure is circulated through one or more tubes mounted in the shell. The pressure of the fluid flowing through the shell is lower than the pressure of the fluid in the tubes. The closure includes a single seal member for sealing between the tube sheet and the shell terminal member and between the tube sheet and the closure member and between the terminal member and the closure member. The tubes are bent in a hairpin shape with a separate closure at each end of the tubes. An opening in the end of the shell allows the tube and tube sheet to be inserted into and removed from the interior of the shell.

6 Claims, 6 Drawing Figures

FIG. 1
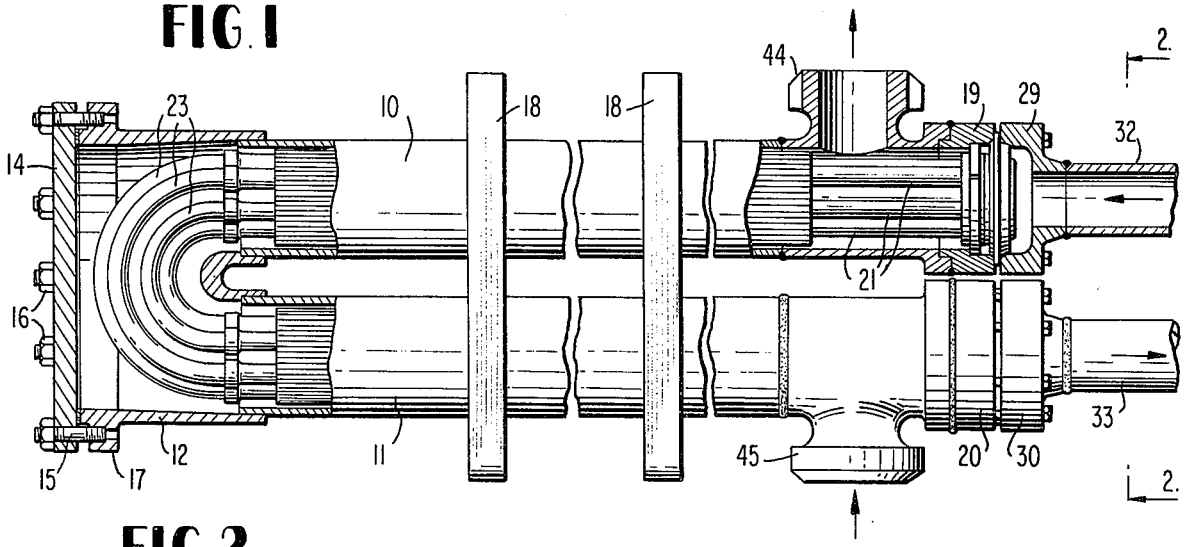
FIG. 2
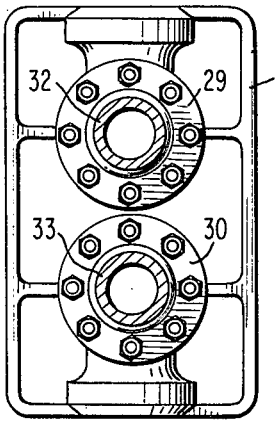
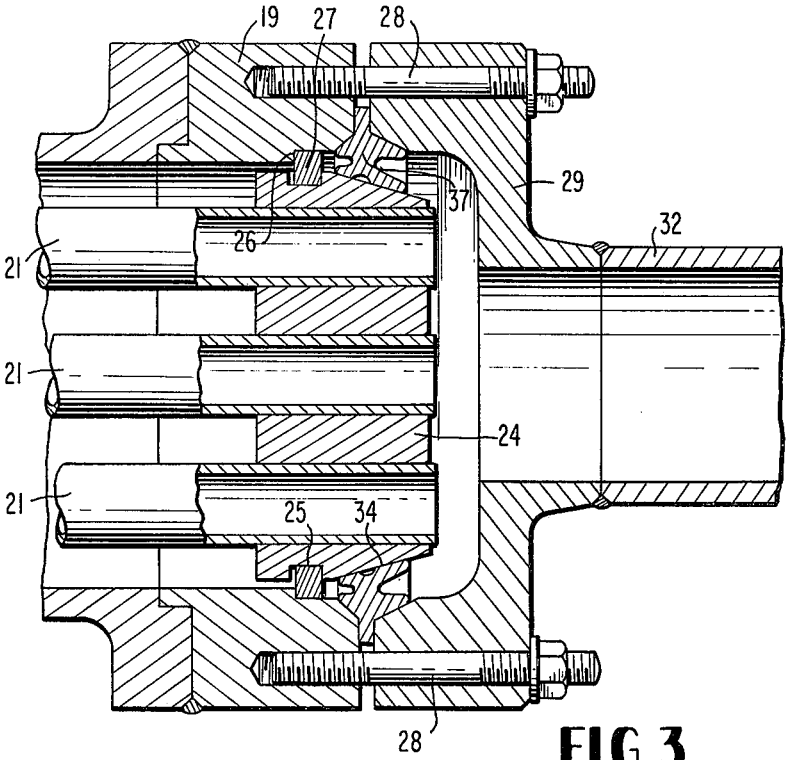
FIG. 3
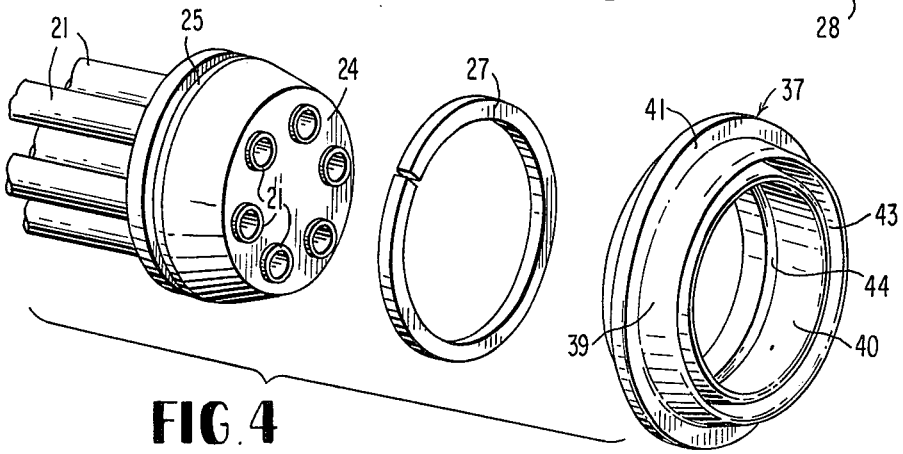
FIG. 4

CLOSURE FOR HEAT EXCHANGER

BACKGROUND OF THE INVENTION

This invention relates to closures for fluid conduits, and more particularly to arrangements for sealing joints between cooperating tubular members.

The closure of this invention is particularly suitable for heat exchangers of the hairpin type. Examples of such hairpin type heat exchangers are disclosed in U.S. Pat. Nos. 3,155,404 and 3,377,087.

Hairpin type heat exchangers typically have a plurality of tubes bent in the shape of a U. A tube sheet is provided for the inlet end of the tubes and a second tube sheet is provided for the outlet end of the tubes. Each tube sheet has a plurality of holes and the ends of the tubes are secured in the respective tube sheets. A shell which is also generally U-shaped has an opening at one end to allow the tubes and the tube sheets to slide longitudinally through the straight sections of the shell, until both tube sheets are positioned at their respective inlet and outlet ends of the shell. The tube sheets have a sufficiently small diameter to pass through the longitudinal portions of the shell. A cover is applied over the opening at the end of the shell adjacent the bend in the tubes, so that fluid may be circulated through the interior of the shell in heat exchange relation with fluid flowing through the interior of the tubes.

A terminal member or flange on the shell surrounding the tube sheet is provided with a shoulder in opposition to a corresponding shoulder on the tube sheets and a locking ring is placed between the opposed shoulders to secure the tubes in the shell. A closure member is secured over the end of each of the shell terminal members to conduct the heat transfer fluid into and out of the interior of the tubes adjacent the tube sheets. Typically, a seal is provided to prevent the leakage of fluid around the periphery of the tube sheet.

Although these prior closures are satisfactory for use with tube side pressures as high as 2000 p.s.i.g., the seals would fail if higher fluid pressures were encountered. Typically the seal rings are clamped in place by bolts tightened between bolt flanges. In order to retain the seal rings in place at higher pressures, larger bolts and flanges would be required. The larger bolts and flanges necessarily increase the size and cost of the closure, and there is a practical limit to the setting force that can be applied in this way.

Permanent type seals are unsuitable because the closure must allow periodic inspection and replacement of the tubes. Preferably, the seal arrangement should be capable of being installed quickly and easily.

SUMMARY OF THE INVENTION

The subject matter of the invention is a closure arrangement for hairpin type heat exchangers. The closure includes a sealing surface on the tube sheet and corresponding sealing surfaces on the shell terminal member and on the closure member. The closure also includes a seal ring which has an axial groove exposed to fluid pressure on the tube side of the tube sheet to expand portions of the gasket generally radially against the tube sheet sealing surface and the closure sealing surface. A similar groove is provided on the opposite side of the gasket and is exposed to fluid pressure on the interior of the shell to urge adjacent portions of the gasket against the tube sheet sealing surface and the terminal member sealing surface.

In accordance with a preferred embodiment of the invention, the gasket also includes a radial rib which serves as a stop between the shell terminal member and the closure member. The rib prevents the grooves in the seal ring from being collapsed by excessive tightening of the bolts. The gasket also includes an internal cavity and vent passages from the cavity through the rib. The vent passages allow fluid that has leaked along the tube sheet sealing surface to pass outwardly through the passages to the exterior of the closure.

High pressure fluid on the tube side expands the tube side of the gasket radially to seat against the sealing surfaces on the tube sheet and the closure member. Intermediate pressure in the shell also expands the shell side of the gasket radially to seat against the sealing surfaces of the tube sheet and the shell terminal member. Thus, the seal is self-energizing due to the fluid pressure in the tubes and the shell, and is effective to prevent leakage at varying pressures.

BRIEF DESCRIPTION OF THE DRAWINGS

A preferred embodiment of the invention is illustrated in the accompanying drawings in which:

FIG. 1 is a side elevational view, partially in cross-section of a hairpin heat exchanger incorporating the closure arrangement of this invention;

FIG. 2 is a cross-sectional view along the line 2—2 in FIG. 1;

FIG. 3 is an enlarged cross-sectional view of the closure portion of the heat exchanger;

FIG. 4 is an exploded view of the tube sheet locking ring and gasket;

DETAILED DESCRIPTION

Figure 5:
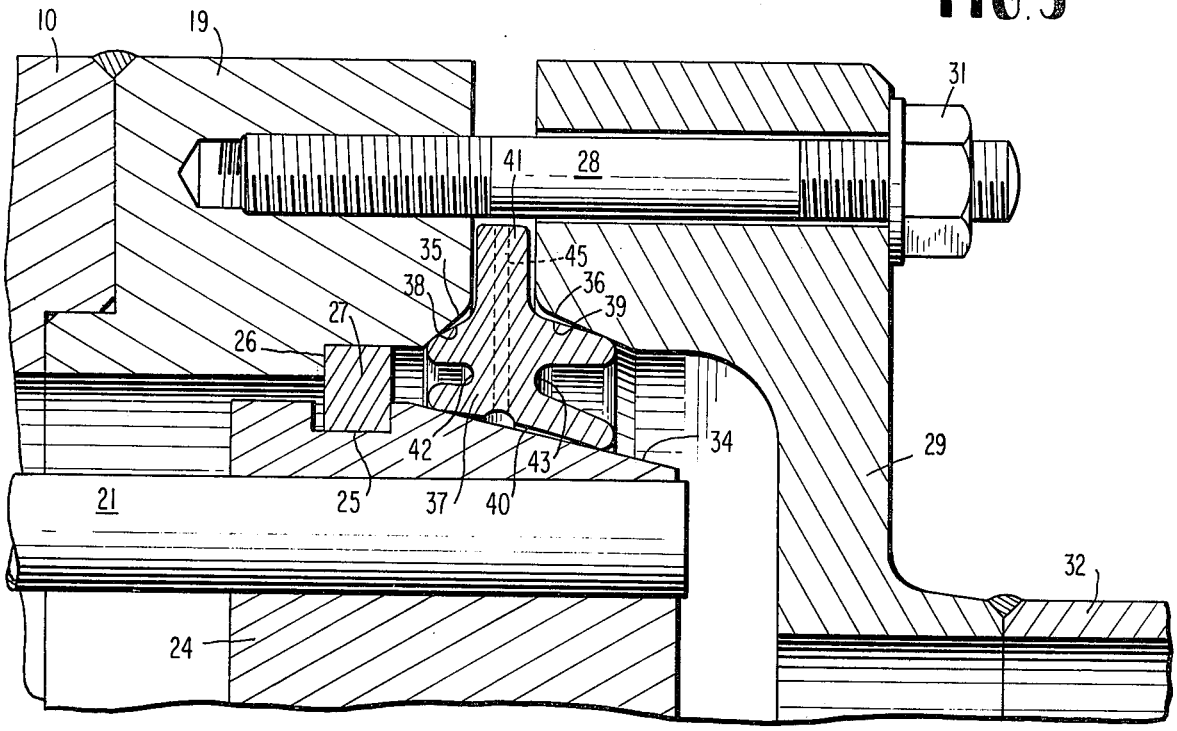
FIG. 5 is an enlarged cross-sectional view of the closure portion showing the gasket partially seated.

As shown in FIGS. 1, 2 and 3 of the drawings, the heat exchanger includes a pair of tubular shells 10 and 11 which are connected together at the rear end by a return housing 12. The housing 12 has an opening at the rear end. A cover 14 is removably secured over the housing opening by studs 15 which cooperate with nuts 16 to clamp the cover to the flange 17 of the housing.

The tubular shells 10 and 11 are supported in parallel relation by frame members 18 which are spaced along the length of the shells. The forward end of the shells are provided with terminal members 19 and 20. A plurality of hairpin tubes 21 are mounted within the shells 10 and 11. Each tube 21 has two straight sections, preferably provided with radial fins, and the rearward ends of the straight sections are connected by return bends 23 within the housing 12.

The forward end of each of the straight sections of the hairpin tubes 21 is secured in a tube sheet 24, so that the tubes are properly spaced from the shell and from each other. The tube sheet 24 also facilitates the installation of the tubes in the shell. The ends of the tubes are sealed in holes in the tube sheet 24 to prevent leakage of fluid between the exterior of the tubes and the wall of the hole through the tube sheet 24. For example, in accordance with conventional techniques, the holes through the tube sheet may have circumferential grooves and the wall of the tubes 21 may be rolled, thereby deforming the wall to lock the tubes in place and to form a fluid-tight seal.

The tube sheet 24 has a circumferential groove 25 in its peripheral surface. A shoulder 26 is provided in the interior surface of the terminal member 19, and a metal split ring 27 is seated in the groove 25 and abuts against the shoulder 26 to prevent movement of the tube sheet 24 toward the left as viewed in FIG. 5.

The terminal members 19 and 20 are provided with studs 28 for securing bolt flanges 29 and 30 over the respective terminal members. By tightening the nuts 31 on the studs 28, the position of the flanges relative to the members 19 and 20 can be adjusted. The flange 29 is secured on an inlet conduit 32 and the flange is secured on an outlet conduit 33. The closure arrangements in the flanges 29 and 30 are identidal and therefore only the arrangement for the inlet flange 29 is described herein.

Figure 6:
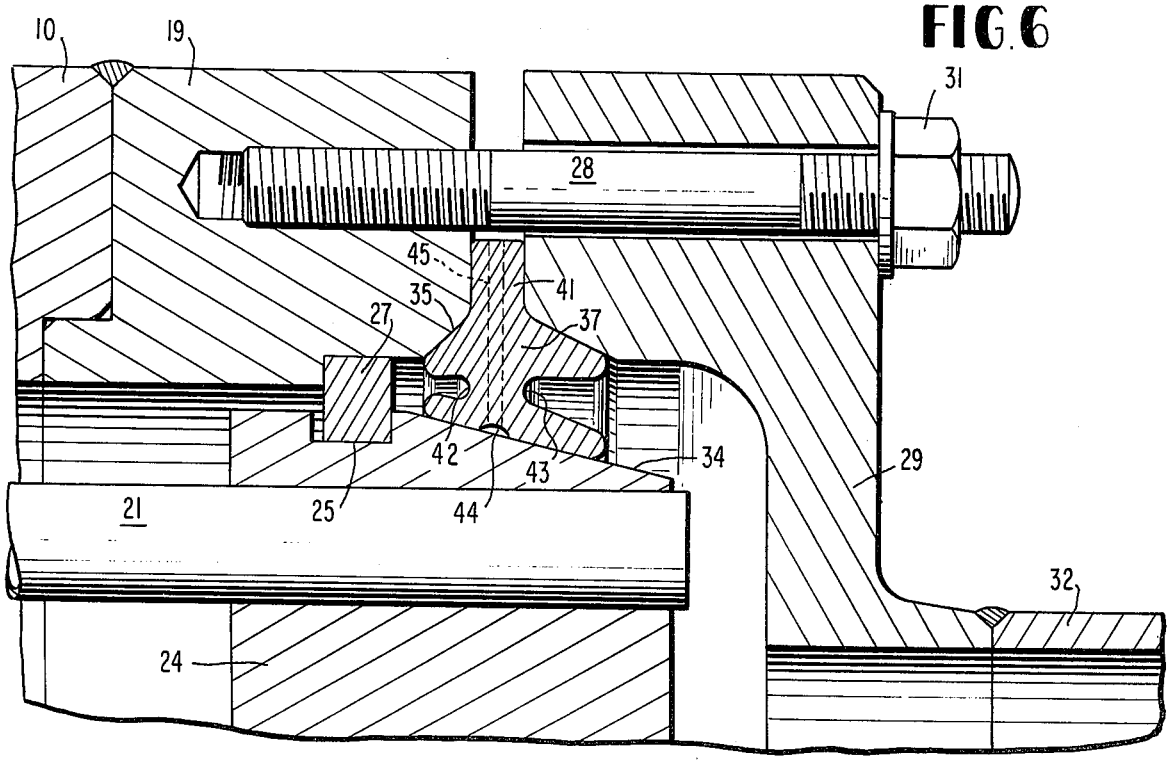
FIG. 6 is an enlarged cross-sectional view of the closure portion showing the gasket seated under pressure.

The periphery of the tube sheet 24 preferably has a frustoconical sealing surface 34. The terminal member 19 has an internal chamfer which forms a sealing surface 35 (FIG. 5). The bolt flange 29 has a similar chamfer which forms a sealing surface 36. A gasket 37 is positioned in the space between the sealing surfaces 34, 35 and 36. Preferably, the gasket is formed of steel, brass, or other metal compatible with the terminal member 19, the tube sheet 24 and the flange 29. The gasket material should be substantially incompressible, but should have sufficient flexibility to be deflected into engagement with the sealing surfaces under normal operating fluid pressures. The gasket 37 is shown in FIG. 5 in its free and unstressed condition, and is shown in FIG. 6 in its operative condition.

The gasket has lateral sloping surfaces 38 and 39 and an inner surface 40. The sealing surfaces 35 and 36 each have a slope that is at least 1 degree greater than the slope of the lateral surfaces 38 and 39 on the gasket 37. This arrangement provides for an initial line contact between the gasket and the corresponding sealing surfaces near the outer edges of the lateral surfaces 38 and 39. Progressive tightening of the flange nuts 31 deflects the gasket at the lateral surfaces until the opposing faces of the terminal member 19 and the flange 29 engage the opposite sides of the stop ring portion 41 of the gasket 37, as shown in FIG. 6. Circumferential grooves 42 and 43 in the gasket accommodate deflection of the surfaces 38, 39 and 40, and also urge these surfaces outwardly in response to fluid pressure in the grooves.

The gasket is also provided with an inner groove 44 for receiving fluid that may leak along the sealing surface 34. A radial passage 45 communicates between the bottom of the groove 44 and the periphery of the stop ring 41.

The shell 10 has an outlet port 46 and the shell 11 has an inlet port 47. When the closure is secured in place as shown in FIGS. 1 and 6, high pressure fluid may be conducted through the inlet conduit 32 and through the tubes 21 in the shell 10. The direction of the fluid flow is reversed as it passes through the return bends 23. The fluid then flows through the tubes in the shell 11 and through the outlet conduit 33. The shell fluid is conducted into the lower tubular shell 11 through the port 47 where it flows along the tubes, through the return housing 12, and along the tubular shell 10 and is discharged through the outlet port 46.

The pressure of the fluid in the tubes 21 is applied to the circumferential groove 43 and the pressure of the fluid acting on the opposite sides of the groove urge the surfaces 39 and 40 of the gasket tightly into engagement with the sealing surfaces 34 and 36. The opposite groove 42 is exposed to the pressure of the fluid in the shell 10 and urges the gasket tightly into engagement with the sealing surfaces 34 and 35. The pressure in the inner groove 40 of the gasket is lower than the pressure on either side of the gasket and any fluid that leaks into the groove is conducted to the exterior of the closure through the passage 43.

The tubes 21 and tube sheet 24 can be removed from the shells 10 and 11 for inspection or replacement by removing the cover 14 and by applying a force on the return bends 23 to force the tubes 21 and the tube sheet 24 toward the right as viewed in FIG. 5 until the ring 27 is positioned beyond the sealing surface 35. The locking ring 27 can then be removed from the groove 25. After the locking ring 27 has been removed, the tubes and the tube sheet 24 are displaced toward the left and removed through the opening in the return housing 12. The tubes in the tube sheet are inserted in the shells 10 and 11 by reversing this procedure.

The gasket of this invention can be easily installed since it is formed in one piece and yet seals three surfaces. The frustoconical sealing surface 34 facilitates mounting the gasket over the end of the tube sheet 24. It would also be possible to provide a substantially cylindrical sealing surface 34, but this would make it more difficult to install the gasket. The stop ring portion 41 of the gasket not only functions to limit the spacing between the member 19 and the flange 29, but also resists any tendency for the gasket to be forced toward the low pressure side due to the high pressure on the tube side acting in a generally axial direction.

In conventional closure seals, fluid pressure is resisted by the clamping force applied to the seal element by the flange bolts. In accordance with this invention, only nominal force is required to set the seal. The primary sealing effect is accomplished by fluid pressure urging portions of the gasket against the sealing surfaces. The higher the fluid pressure, the greater sealing effect is achieved. Pressures as high as 2000 p.s.i. are commonly encountered in heat exchangers of this type. Since the flange bolts are not required to apply a large axial force to maintain the seal, the size of the bolts and the diameter of the flanges can be made smaller than those used with force-type seals at comparable pressures.

While this invention has been illustrated in accordance with a preferred embodiment, it is recognized that variations and changes may be made therein without departing from the invention as set forth in the claims.

What is claimed is:

1. In a heat exchanger of the type having one or more tubes arranged in a hairpin shape and enclosed by a shell, the free ends of the tube or tubes being secured in a tube sheet, said tube sheet having sufficient clearance inside said shell to allow removal of said tube or tubes and said tube sheet through said shell, and including a locking ring for temporarily securing said tube sheet against movement relative to a terminal member of said shell, a closure member bolted on said shell terminal member for connecting a conduit with said tube or tubes, and a sealing arrangement for preventing the leakage of fluid between said shell terminal member and said tube sheet and between said shell terminal member and said closure member and between said closure member and said tube sheet, the improvement wherein said seal arrangement comprises:

a sealing surface on the exterior of said tube sheet between said locking ring and the terminal end of said tube sheet;

said terminal member having an internal frustoconical seat adjacent said locking ring and spaced radially outward from said tube sheet sealing surface;

said closure member having a frustoconical seat spaced radially outward from said tube sheet sealing surface and spaced axially from said terminal member seat;

a sealing gasket interposed between said tube sheet sealing surface and said closure member seat and said terminal member seat, said sealing gasket having circumferential grooves on axially opposite sides thereof, whereby fluid pressure urges adjacent portions of said gasket against said seats and said sealing surfaces.

2. The heat exchanger closure according to claim 1 wherein said tube sheet sealing surface is substantially frustoconical.

3. The heat exchanger closure according to claim 1 wherein said sealing gasket is a unitary metallic ring.

4. The heat exchanger closure according to claim 1 wherein said gasket includes a radial rib clamped between said terminal member and said closure member.

5. The heat exchanger closure according to claim 4 wherein said gasket includes a passage extending from said tube sheet surface outward through said radial rib.

6. The heat exchanger closure according to claim 4 wherein said gasket has a first lateral sloping surface in engagement with said closure member seat and a second lateral sloping surface in engagement with said terminal member seat, said seats having a greater slope than the corresponding lateral sloping surface of the gasket when said gasket is unstressed, whereby upon assembly said seats engage and partially deflect said lateral surfaces before said rib is clamped between said members.

* * * * *